US006540013B1

(12) United States Patent
Doles

(10) Patent No.: US 6,540,013 B1
(45) Date of Patent: Apr. 1, 2003

(54) METHOD OF INCREASING THE STRENGTH AND SOLIDS LEVEL OF INVESTMENT CASTING SHELLS

(75) Inventor: Ronald S. Doles, La Grange Park, IL (US)

(73) Assignee: Ondeo Nalco Company, Naperville, IL (US)

( * ) Notice: Subject to any disclaimer, the term of this patent is extended or adjusted under 35 U.S.C. 154(b) by 0 days.

(21) Appl. No.: 09/876,613

(22) Filed: Jun. 7, 2001

(51) Int. Cl.[7] ..... B22C 1/02; B22C 9/04
(52) U.S. Cl. ..... 164/519; 164/361
(58) Field of Search ..... 164/519, 35, 361, 164/529

(56) References Cited

U.S. PATENT DOCUMENTS 4,019,558 A * 4/1977 Szabo ..... 164/516
5,303,762 A * 4/1994 Chandley ..... 164/255
5,391,606 A 2/1995 Doles
5,824,730 A 10/1998 Guerra, Jr.
6,000,457 A 12/1999 Vandermeer
6,020,415 A 2/2000 Guerra, Jr.

FOREIGN PATENT DOCUMENTS

JP 51-72922 * 6/1976

* cited by examiner

*Primary Examiner*—Kuang Y. Lin
(74) *Attorney, Agent, or Firm*—Kelly L. Cummings; Thomas M. Breininger

(57) ABSTRACT

The strength and solids level of an investment casting shell is increased by incorporating at least one microsilica into the shell.

7 Claims, No Drawings

METHOD OF INCREASING THE STRENGTH AND SOLIDS LEVEL OF INVESTMENT CASTING SHELLS

FIELD OF THE INVENTION

This invention relates generally to investment casting and, more particularly, to a method of increasing the strength and solids level of investment casting shells.

BACKGROUND OF THE INVENTION

Investment casting, which has also been called lost wax, lost pattern and precision casting, is used to produce high quality metal articles that meet relatively close dimensional tolerances. Typically, an investment casting is made by first constructing a thin-walled ceramic mold, known as an investment casting shell, into which a molten metal can be introduced.

Shells are usually constructed by first making a facsimile or pattern from a meltable substrate of the metal object to be made by investment casting. Suitable meltable substrates may include, for example, wax, polystyrene or plastic.

Next, a ceramic shell is formed around the pattern. This may be accomplished by dipping the pattern into a slurry containing a mixture of liquid refractory binders such as colloidal silica or ethyl silicate, plus a refractory powder such as quartz, fused silica, zircon, alumina or aluminosilicate and then sieving dry refractory grains onto the freshly dipped pattern. The most commonly used dry refractory grains include quartz, fused silica, zircon, alumina and aluminosilicate.

The steps of dipping the pattern into a refractory slurry and then sieving onto the freshly dipped pattern dry refractory grains may be repeated until the desired thickness of the shell is obtained. However, it is preferable if each coat of slurry and refractory grains is air-dried before subsequent coats are applied.

The shells are built up to a thickness in the range of about ⅛ to about ½ of an inch (from about 0.31 to about 1.27 cm). After the final dipping and sieving, the shell is thoroughly air-dried. The shells made by this procedure have been called "stuccoed" shells because of the texture of the shell's surface.

The shell is then heated to at least the melting point of the meltable substrate. In this step, the pattern is melted away leaving only the shell and any residual meltable substrate. The shell is then heated to a temperature high enough to vaporize any residual meltable substrate from the shell. Usually before the shell has cooled from this high temperature heating, the shell is filled with molten metal. Various methods have been used to introduce molten metal into shells including gravity, pressure, vacuum and centrifugal methods. When the molten metal in the casting mold has solidified and cooled sufficiently, the casting may be removed from the shell.

Although investment casting has been known and used for thousands of years, the investment casting market continues to grow as the demand for more intricate and complicated parts increase. Because of the great demand for high quality, precision castings, there continuously remains a need to develop new ways to make investment casting shells more efficiently, cost-effective and defect-free. For instance, if the strength of investment casting shells could be increased, less material would be required. The stronger shells would also be more crack resistant, thereby resulting in castings with fewer defects. Furthermore, if the solids level of investment casting shells could be increased, the shells would dry faster and be made with fewer coats for additional time, material and cost savings.

Accordingly, it would be desirable to provide an improved method of increasing the strength and solids level of investment casting shells.

SUMMARY OF THE INVENTION

The method of the invention calls for incorporating at least one microsilica into an investment casting shell. The addition of the microsilica effectively increases the strength and solids level of the investment casting shell.

DETAILED DESCRIPTION OF THE INVENTION

The present invention is directed to a method of increasing the strength and solids level of investment casting shells. In accordance with the invention, at least one microsilica is incorporated into the shell. The microsilica can be introduced into the investment casting shell by adding the microsilica to the slurry via any conventional method generally known to those skilled in the art.

The microsilicas which may be used in the practice of the invention include man-made microsilicas such as silica fume and fumed silica, naturally-occurring microsilicas, known as pozzolans, and mixtures thereof. Examples of suitable pozzolans include diatomaceous earth, opaline cherts and shales, tuffs, volcanic ashes, pumicites and fly ash. The preferred microsilica for use in increasing the strength and solids level of investment casting shells is silica fume. By definition, "silica fume" is a by-product of silicon, ferrosilicon or fused silica manufacture.

The microsilica is used at a concentration which will effectively increase the strength and solids level of an investment casting shell. It is preferred that the amount of microsilica which is added to the shell be in the range of about 0.1 to about 15.0% by weight of the shell. More preferably, the amount of microsilica is from about 0.2 to about 10.0%, with about 0.5 to about 5.0% being most preferred.

The present inventor has discovered that incorporating at least one microsilica into an investment casting shell effectively increases the strength and solids level of the shell. The inventor has also found that microsilica additions create stronger shells with fewer coats, thus providing for material savings and productivity enhancement, as well as higher quality molds to produce castings with fewer defects.

EXAMPLES

The following examples are intended to be illustrative of the present invention and to teach one of ordinary skill how to make and use the invention. These examples are not intended to limit the invention or its protection in any way.

Example 1

Slurries were prepared using the following formulas:

TABLE 1

| Slurry Ingredients | Concentrations (ratios) |
|---|---|
| Colloidal silica[1] | 1576 g |
| Deionized water | 315 g |

TABLE 1-continued

| Slurry Ingredients | Concentrations (ratios) |
|---|---|
| Latrix ® 6305 polymer[2] | 189 g |
| Nalcast ® P1 (−200 mesh) fused silica[3] | 1105 g |
| Nalcast ® P2 (−120 mesh) fused silica[4] | 3315 g |
| Nalco ® 8815 anionic wetting agent[5] | 1.5 g |
| Dow Corning ® Y-30 antifoam[6] | 4.2 g |
| Stealth ® ⅛" polypropylene fiber[7] | 19.5 g |
| Silica fume[8] | 260 g |

[1]Nalcoag ® 1130 (8 nanometer, sodium stabilized) diluted to 25% silica (available from ONDEO Nalco Company)
[2]Styrene butadiene latex at 10% based on diluted colloidal silica (available from ONDEO Nalco Company)
[3]Available from ONDEO Nalco Company
[4]Available from ONDEO Nalco Company
[5]70% sodium dioctyl sulfosuccinate (available from ONDEO Nalco Company)
[6]30% silicone emulsion (available from Dow Corning Corporation of Midland, Michigan)
[7]Available from Synthetic Industries, Inc. of Chickamauga, Georgia
[8]Regular grade (microsilica) from Globe Metallugical of Beverly, Ohio After seventy-two hours of mixing, the viscosities of the slurries were measured and adjusted using a number five Zahn cup. The viscosities ranged from 9–12 seconds. Minor binder additions (colloidal silica+water+polymer) were made to obtain the desired rheology. Once adjusted, the slurries were ready for dipping.

Wax patterns were cleaned and etched using Nalco® 6270 pattern cleaner followed by a water rinse. Wax bars were dipped into each slurry followed by Nalcast® S2 (30×50 mesh) fused silica stucco (applied by the rainfall method). Dry times started at 1.5 hours and progressed up to 3.5 hours as coats were added. The final shells had four coats with Nalcast® S2 stucco plus one seal coat (no stucco). All coats were dried at 73–75° F., 35–45% relative humidity and air flows of 200–300 feet per minute. After a twenty-four hour final dry, the shells were placed into a desiccator for an additional twenty-four hours prior to testing.

Several shell properties were evaluated using modulus of rupture (MOR) bars prepared from the experimental slurries. The bars were broken with a three point bending fixture on an ATS universal test machine (available from Applied Test Systems, Inc. of Butler, Pa.). The analog output (voltage) was fed into a personal computer containing an analog-to-digital conversion board and data acquisition software. The data was stored as a load versus time, or load versus displacement plot. Calculations and analyses were performed using data acquisition software or spreadsheet programs. The following physical properties were determined for the MOR specimens:

Fracture Load

The fracture load is the maximum load that the test specimen is capable of supporting. The higher the load, the stronger the test specimen. It is affected by the shell thickness, slurry and shell composition. This property is important for predicting shell cracking and related casting defects. The fracture load is measured and recorded for test specimens in the green (air dried), fired (held at 1800° F. for one hour and cooled to room temperature) and hot (held at 1800° F. for one hour and broken at temperature) condition. Results are normalized and expressed as an Adjusted Fracture Load (AFL). The AFL is simply the fracture load divided by the specimen width for a two inch test span.

Shell Thickness

Shell thickness is influenced by slurry and shell composition, combined with the shell building process. Thickness fluctuations are indicative of process instability. Non-uniform shell thickness creates stresses within the shell during drying, dewaxing, preheating and pouring. Severe cases lead to mold failure. The mold surrounds and insulates the cooling metal. Changes in thickness can affect casting microstructure, shrinkage, fill and solidification rates.

Modulus of Rupture

A flat ceramic plate is prepared using a rectangular wax bar as the pattern. Typical dimensions are 1×8×¼ inches. The bar is invested using the desired shell system. After drying, the edges are removed with a belt sander. The two remaining plates are separated from the wax, yielding two test specimens. The specimens are broken using a three point loading apparatus on an ATS universal test machine. MORs are calculated for bars in the green, fired and hot conditions.

$$MOR = \frac{3PL}{2bh^2}$$

where

P=Fracture load in pounds

L=Specimen length in inches (distance between supports)

b=Specimen width at point of failure in inches h=Specimen thickness at point of failure in inches The MOR is a fracture stress. It is influenced by fracture load and specimen dimensions. Shell thickness is of particular importance since the stress is inversely proportional to this value squared. The uneven nature of the shell surface makes this dimension difficult to accurately measure, resulting in large standard deviations. This deficiency is overcome by breaking and measuring a sufficient number of test specimens.

Bending or Deflection

The test specimen bends as the load is applied. The maximum deflection is recorded as the specimen breaks. Bending increases with flexibility and polymer concentration. A flexible shell is capable of withstanding the expansion and contraction of a wax pattern during the shell building process. Bending is measured for bars in the green condition.

Fracture Index

The fracture index is a measure of the work or energy required to break a shell in the green condition. It is indicative of shell "toughness", i.e., the higher the index, the tougher the material. For example, a polypropylene bottle is "tougher" than a glass bottle and therefore has a higher fracture index. The index is an indicator of crack resistance. High index shells require more energy to break them than low index systems.

The fracture index is influenced by slurry and shell composition. Polymer additives increase the index. Soft polymers produce higher index shells than stiff ones. The index is proportional to shell flexibility. A shell that is capable of yielding absorbs more energy than a rigid, brittle one.

The fracture index is determined by integrating the area beneath the load/displacement curve for a MOR test specimen. The index measures (force)×(distance) when monitoring displacement or (force)×(time) when monitoring load time. To convert from (force)×(time) to (force)×(distance), the loading rate is used. Test results are normalized by simply dividing the index value by the specimen width for a two inch test span.

As shown below in Table 2, silica fume increased strength and toughness while reducing fired strength. The best system (P1/P2/Fume) shows a 65% increase in fracture load, 29% increase in MOR and 67% increase in toughness compared with the P1/P2 fiber enhanced system without fume.

TABLE 2

| System | A.F. Load (lbs) | MOR (psi) | MOR (kpsi) | Bending (mils) | A.F. Index |
|---|---|---|---|---|---|
| Green Results | | | | | |
| P1/P2 | 10.71 | 483 | 181 | 7.03 | 48.5 |
| P1/P2/Fume | 17.70 | 621 | 205 | 7.10 | 80.5 |
| Hot Results | | | | | |
| P1/P2 | 24.61 | 1067 | | | |
| P1/P2/Fume | 35.82 | 1287 | | | |
| Fired Results | | | | | |
| P1/P2 | 13.41 | 600 | | | |
| P1/P2/Fume | 14.38 | 538 | | | |

Example 2

Slurries were prepared using the following formulas:

TABLE 3

| Slurry Ingredients | Concentrations (ratios) |
|---|---|
| Colloidal silica | 1477 g |
| Deionized water | 296 g |
| TX-11280 polymer[1] | 0.0 g (0%), 88.7 g (5.0%), 177.0 g (10.0%) |
| Fused silica blend (−270/−200/−120 mesh)[2] | 4550 g |
| Nalco ® 8815 anionic wetting agent | 1.5 g |
| Dow Corning ® Y-30 antifoam | 4.2 g |
| Stealth ® ⅛" polypropylene fiber | 16.3 g |
| Silica fume | 0.0 g (0%), 130 g (2.0%), 260 (4.0%), 325 g (5.0%), 390 g (6.0%) |

[1]Styrene-butadiene (SBR) latex at 0–10% based on diluted colloidal silica (available from ONDEO Nalco Company)
[2]Blend of 270 mesh fused silica (available from C-E Minerals of King of Prussia, PA), Nalcast ® P1(−200 mesh) and Nalcast ® P2 (−120 mesh) (the Nalcast ® products are available from ONDEO Nalco Company). The approximate ratio of the blend is 20/20/60.

The slurry and shell preparation procedures were the same as described above in Example 1. The shell test methods were also the same.

As shown below in Table 4, the addition of the silica fume reduced slurry viscosities, increased solids content and increased shell strength. Higher solids contents lead to shorter dry times, stronger shells and improved productivity. When used in combination with the polypropylene fiber, high performance molds are produced with a minimum of coats. The green, hot and fired MOR results for slurries with and without silica fume additions were as follows:

TABLE 4

| | Green MOR | Hot MOR | Fired MOR | % Solids |
|---|---|---|---|---|
| 0% TX-11280 Polymer | | | | |
| 0.0% silica fume | 449 psi | 1335 psi | 467 psi | 76.00 |
| 4.0% silica fume | 589 psi | 1730 psi | 708 psi | 79.45 |
| 5% TX-11280 Polymer | | | | |
| 2.0% silica fume | 671 psi | 1646 psi | 506 psi | 77.71 |
| 6.0% silica fume | 745 psi | 1808 psi | 801 psi | 80.12 |
| 10% TX-11280 Polymer | | | | |
| 0.0% silica fume | 783 psi | 1398 psi | 711 psi | 77.44 |
| 4.0% silica fume | 848 psi | 1914 psi | 805 psi | 79.24 |
| 5.0% silica fume | 918 psi | 1821 psi | 745 psi | 79.81 |

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

What is claimed is:

1. A method of increasing the strength and solids level of an investment casting shell, wherein the shell is made from the deposition of alternating layers of a refractory slurry and a refractory stucco onto a pattern, which comprises the step of incorporating into the shell via the slurry an effective amount of at least one microsilica.

2. The method of claim 1 wherein the microsilica is selected from the group consisting of silica fume, fumed silica, pozzolans and mixtures thereof.

3. The method of claim 2 wherein the pozzolans are selected from the group consisting of diatomaceous earth, opaline cherts and shales, tuffs, volcanic ashes, pumicites and fly ash.

4. The method of claim 2 wherein the microsilica is silica fume.

5. The method of claim 1 wherein the microsilica is added to the shell in an amount from about 0.5 to about 10.0% by weight of the shell.

6. The method of claim 1 wherein the microsilica is added to the shell in an amount from about 0.5 to about 5.0% by weight of the shell.

7. A method of increasing the strength and solids level of an investment casting shell, wherein the shell is made from the deposition of alternating layers of a refractory slurry and a refractory stucco onto a pattern, which comprises the step of incorporating silica fume into the shell via the slurry in an amount from about 0.5 to about 5% by weight of the shell.

* * * * *

UNITED STATES PATENT AND TRADEMARK OFFICE

CERTIFICATE OF CORRECTION

PATENT NO. : 6,540,013 B1
DATED : April 1, 2003
INVENTOR(S) : Ronald S. Doles

It is certified that error appears in the above-identified patent and that said Letters Patent is hereby corrected as shown below:

Column 6,
Line 31, replace "into the shell via the slurry an effective amount of at least one microsilica" with -- at least one microsilica into the shell via the slurry in an amount from about 0.5 to about 15 percent by weight of the shell --.

Signed and Sealed this

Thirteenth Day of September, 2005

JON W. DUDAS
*Director of the United States Patent and Trademark Office*